United States Patent [19]

Koyama et al.

[11] Patent Number: 4,665,729

[45] Date of Patent: May 19, 1987

[54] THICKNESS CONTROL METHOD AND SYSTEM FOR A SINGLE-STAND/MULTI-PASS ROLLING MILL

[75] Inventors: Toshihiro Koyama, Koganei; Takahiro Watanabe, Fuchu; Hiroyuki Shiozaki, Yokosuka; Takao Kawanami; Hideo Takahashi, both of Kitakyushu; Toshiyuki Shiraishi; Ken Okudaira, both of Kitakyushu, all of Japan

[73] Assignees: Kabushiki Kaisha Toshiba, Kawasaki; Nippon Steel Corporation; Ishikawajima-Harima Jukogyo Kabushiki Kaisha, both of Tokyo, all of Japan

[21] Appl. No.: 763,678

[22] Filed: Aug. 8, 1985

[30] Foreign Application Priority Data

| | | | |
|---|---|---|---|
| Aug. 10, 1984 | [JP] | Japan | 59-167576 |
| Aug. 10, 1984 | [JP] | Japan | 59-167577 |
| Apr. 10, 1985 | [JP] | Japan | 60-76269 |

[51] Int. Cl.[4] ..... B21B 37/12

[52] U.S. Cl. ..... 72/8; 72/16; 72/205; 72/232; 72/243

[58] Field of Search ..... 72/8, 16, 205, 10–12, 72/20, 243, 245, 232

[56] References Cited

U.S. PATENT DOCUMENTS

| | | | |
|---|---|---|---|
| 4,329,863 | 5/1982 | Pryor et al. | 72/205 |
| 4,382,375 | 5/1983 | Yamamoto et al. | 72/205 |
| 4,414,832 | 11/1983 | Brenneman et al. | 72/16 X |

OTHER PUBLICATIONS

M. Tanaka, Patent Abstracts, vol. 8, No. 186, (M-320), (1623), Aug. 25, 1984.

T. Mineura, Patent Abstracts, vol. 8, No. 180 (M-318) (1617), Aug. 18, 1984.

T. Koyama, Patent Abstracts, vol. 8, No. 80 (M-289) (1517), Apr. 12, 1984.

*Primary Examiner*—Robert L. Spruill

*Assistant Examiner*—Steve Katz

*Attorney, Agent, or Firm*—Schwartz, Jeffery, Schwaab, Mack, Blumenthal & Evans

[57] ABSTRACT

In a method and system for controlling a final thickness of a strip material being rolled in a single-stand/multi-pass rolling mill having an adjustable main parameter affecting the final thickness and one or more auxiliary parameters affecting an intermediate thickness, the reference value of the main parameter is corrected in accordance with the deviation of the final thickness from its reference value and a reference value of at least one of the auxiliary parameters is corrected to cancel the effect of the correction to the main parameter on the intermediate thickness.

16 Claims, 6 Drawing Figures

THICKNESS CONTROL METHOD AND SYSTEM FOR A SINGLE-STAND/MULTI-PASS ROLLING MILL

BACKGROUND OF THE INVENTION

The present invention relates to thickness control method and system for a single-stand/multi-pass rolling mill.

In most of the conventional rolling mills, each stand has a single pass. Reduction ratio per stand is at most 40%. When a greater reduction is desired a tandem rolling mill comprising a plurality of stands is used.

However, a tandem rolling mill requires a large floor area for installation and is expensive.

As a measure to reduce the installation floor area, single-stand/multi-pass rolling mills are now drawing attention, in which three or more work rolls are arranged one above another between upper and lower back-up rolls to form a plurality of "passes". With the use of the single-stand/multi-pass rolling mill, the reduction ratio can be made as high as 70%. However, the single-stand/multi-pass rolling mill has a problem in that correction to the roll-gap position reference value for the purpose of controlling the final thickness affects not only the final thickness but also the thickness at the exit of other passes, e.g., the first pass, the second pass and the like. In other words, there is an interference between passes which forms an obstacle to improvement in accuracy of the thickness control. There has not been any satisfactory solution to this problem.

SUMMARY OF THE INVENTION

An object of the invention is to provide thickness control method and system for a single-stand/multi-pass rolling mill by which the final thickness can be accurately controlled.

According to the invention, there are provided thickness control method and system for controlling a final thickness of a strip material being rolled in a single-stand/multi-pass rolling mill, having an adjustable main parameter affecting the final thickness and one or more auxiliary parameters affecting an intermediate thickness, in which a reference value of the main parameter is corrected in accordance with the deviation of the final thickness from its reference value to reduce the deviation of the final thickness; and a reference value of at least one of the auxiliary parameters is corrected in accordance with the correction to the main parameter to cancel the effect of the correction to the main parameter on the intermediate thickness.

The number of the auxiliary parameters whose reference value is corrected may be one less than the number of the passes. The main parameter as referred to above may be a roll-gap position, or alternatively a speed difference ratio between the work rolls at the final pass. Adjustable as the auxiliary parameters are one or more of a back tension, a forward tension, a speed difference ratio between the work rolls of the first or the second pass, the bender force, and the like.

In a preferred embodiment, the rolling mill has three passes, and two of the auxiliary parameters are adjusted for the purpose of the cancellation.

DETAILED DESCRIPTION OF THE PREFERRED EMBODIMENTS

Figure 1:
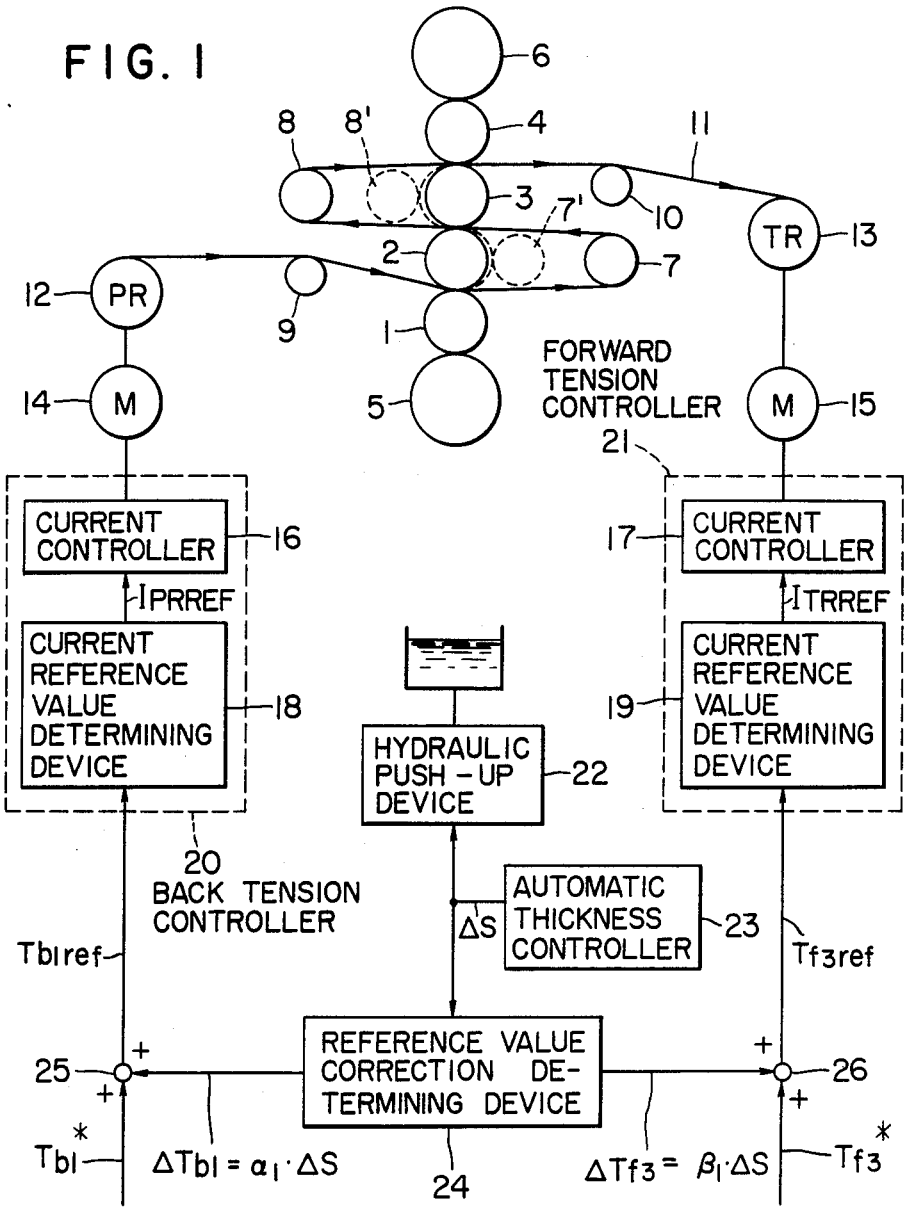
FIGS. 1 through 5 are schematic diagrams respectively showing single-stand/multi-pass rolling mills provided with different control systems embodying the invention.

In a first embodiment shown in FIG. 1, the main parameter as referred to in the Summary of the Invention is the roll-gap position, and back and forward tensions are adjusted as auxiliary parameters.

In FIG. 1, first to fourth work rolls 1–4 are arranged one above another between a lower back-up roll 5 and an upper back-up roll 6. The roll-gap position is adjusted by a hydraulic push-up device 22.

A strip material 11 to be rolled is passed in turn between the work rolls 1–4 in a manner as illustrated. While the strip material 11 is passed between the respective pairs of the work rolls, its thickness is gradually reduced. Thus, three steps of rolling reduction are effected in a single stand. The respective reduction steps are called a first pass, a second pass and a third or final pass. Draw-out rolls 7 and 8 are provided respectively between the first and the second passes and between the second and the third passes to draw the material 11 from between the respective passes.

Where it is unnecessary to draw the material 11 from between adjacent passes, the material may be made to follow a path as illustrated by a broken line.

Even where the material 11 is not drawn out, rolls 7' and 8' are provided in contact with the material 11 to detect the speed of the material.

Provided on the entrance side of the first pass are a pay-off reel 12 from which the strip material 11 is fed and a tension meter roll 9 for detecting the back tension on the material 11. Provided on the exit side of the final pass are a tension meter roll 10 for detecting the forward tension on the material 11 and a tension reel 13 by which the material is wound or coiled. The pay-off reel 12 is driven by an electric motor 14 under control of a back tension controller 20. The tension reel 13 is driven by an electric motor 15 under control of a forward tension controller 21.

Figure 6:
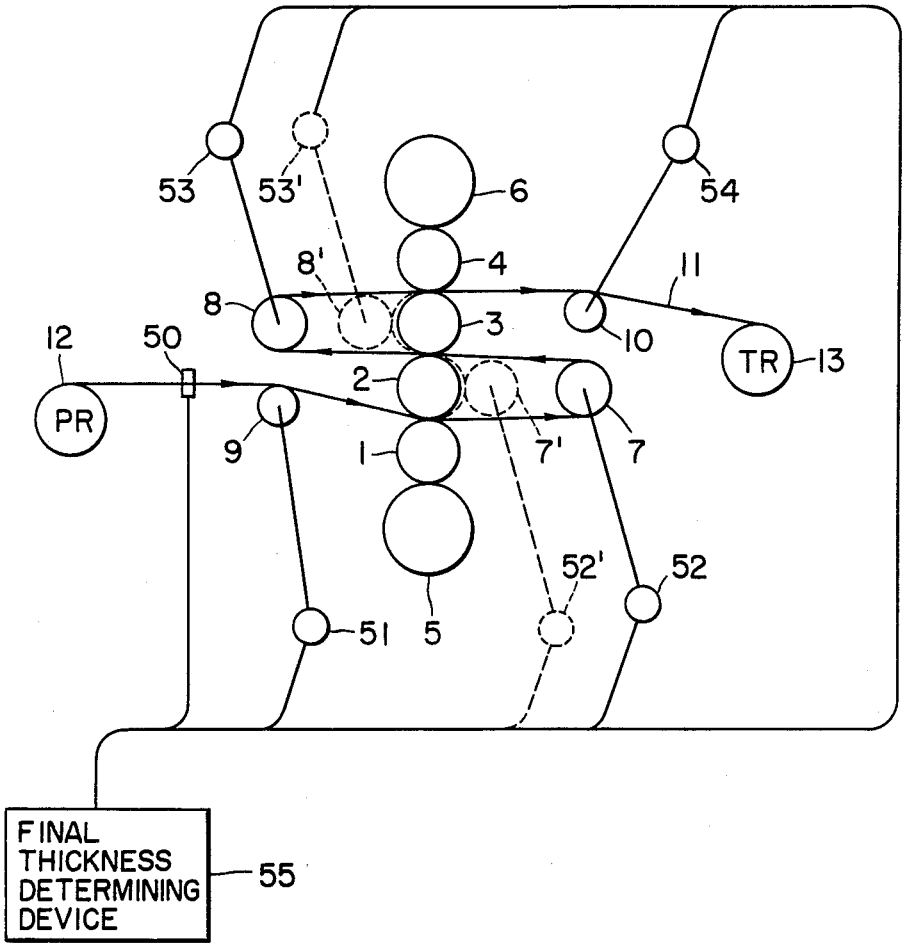
FIG. 6 is a schematic diagram showing an arrangement for determining a final thickness.

An automatic thickness controller 23, which itself is known, receives an actual value of the final thickness and determines the deviation of the actual value from the reference value of the final thickness. The actual value of the final thickness can be determined be any of the conventional manner. For instance a thickness detector may be provided to detect the thickness at the exit of the final pass. Alternatively, as shown in FIG. 6, a thickness detector 50 may be provided to detect the thickness at the entrance of the first pass, and speed detectors 51, 52 or 52', 53 or 53' and 54 are provided to detect the speeds of the strip material being rolled at the respective positions. An actual final thickness determining device 55 receives the thickness at the entrance and the speeds and determines or predicts the final thickness. The principle of the calculation is the constant mass-flow law. With this law, if the speed and the thickness of a particular portion of the strip material at the entrance of each pass are known, and the speed at the exit of the pass is also known, then the thickness which will result at the time when the above-described particular portion reaches the exit of the pass can be calculated in advance. Use of such a value calculated in advance enables a quicker control response.

The automatic thickness controller 23 determines a roll-gap position reference value correction ΔS for reducing the deviation of the final thickness. The correction ΔS represents the deviation of the roll-gap position reference value from the roll-gap position initial set value and is applied to a push-up device 22, and the roll-gap position is adjusted or corrected in accordance with the correction ΔS.

A reference value correction determining device 24 receives the correction ΔS and determines a back tension reference value correction $\Delta T_{b1}$ and a forward tension reference value correction $\Delta T_{f3}$, which are respectively added at adders 25 and 26 to a back tension set value $T_{b1}$* and a forward tension set value $T_{f3}$*. The respective sums constituting a back tension reference value $T_{b1ref}$ and a forward tension reference value $T_{f3ref}$ are applied to the back tension controller 20 and the forward tension controller 21.

The determining device 24 may be formed of a minicomputer, a programmable controller or the like to have the following function. Namely, the device 24 determines the corrections $\Delta T_{b1}$ and $\Delta T_{f3}$ to cancel the effect of the correction to the roll-gap position on the thickness at the exit of the first and the second passes in accordance with the following equations:

$$\Delta T_{b1}=\alpha_1\cdot\Delta S \tag{1}$$

where $\alpha_1$ is a back tension reference value correction determining coefficient.

$$\Delta T_{f3}=\beta_1\cdot\Delta S \tag{2}$$

where $\beta_1$ is a forward tension reference value correction determining coefficient.

The back tension controller 20 comprises a current reference value determining device 18 which converts the back tension reference value $T_{b1ref}$ into a current reference value $I_{PRREF}$ and a current controller 16 which is responsive to the current reference value $I_{PRREF}$ for controlling the torque of the pay-off reel drive motor 14 thereby to vary the back tension.

Similarly, the forward tension controller 21 comprises a current reference value determining device 19 which converts the forward tension reference value $T_{f3ref}$ into a current reference value $I_{TRREF}$ and a current controller 17 which is responsive to the current reference value $I_{TRREF}$ for controlling the torque of the tension reel drive drive motor 15 thereby to vary the forward tension.

The time constants of the hydraulic push-up device 22, the back tension controller 20 and the forward tension controller 21 are in the order of 0.01 sec., so that matching between the response speeds of the push-up device 22 and the tension controllers 20 and 21 which is required for cancelling the effect of the correction to the roll-gap position on the thicknesses at the exit of the first and the second passes, is satisfied.

The coefficients $\alpha_1$ and $\beta_1$ may be determined in various manners.

For example, the following set of equations are first formulated.

$$\Delta h_3=A_{11}\cdot\Delta S+A_{12}\cdot\Delta T_{b1}+A_{13}\cdot\Delta T_{f3} \tag{3}$$

$$\Delta h_2=A_{21}\cdot\Delta S+A_{22}\cdot\Delta T_{b1}+A_{23}\cdot\Delta T_{f3} \tag{4}$$

$$\Delta h_1=A_{31}\cdot\Delta S+A_{32}\cdot\Delta T_{b1}+A_{33}\cdot\Delta T_{f3} \tag{5}$$

where $A_{ij}$ (i=1 to 3, j=1 to 3) represents constants (effect constants);

$\Delta h_j$ (j=1 to 3) represents variations in the thicknesses at the exit of the respective passes;

ΔS represents roll-gap position reference value correction;

$\Delta T_{b1}$ represents the back tension reference value correction; and $\Delta T_{f3}$ represents the forward tension reference value correction.

When a certain correction ΔS is given and, if $\Delta T_{b1}$ and $\Delta T_{f3}$ are kept at 0, then $\Delta h_1$ and $\Delta h_2$ are varied by $A_{31}\cdot\Delta S$ and $A_{21}\cdot\Delta S$, respectively. The variations in the thickness at the first and the second passes will give an adverse effect on the final thickness.

It is therefore desirable that the variations $\Delta h_1$ and $\Delta h_2$ be as small as possible. Accordingly, $\Delta h_1$ and $\Delta h_2$ of the equations (4) and (5) are made to be zero. Then, $$A_{21}\cdot\Delta S+A_{22}\cdot\Delta T_{b1}+A_{23}\cdot\Delta T_{f3}=0 \tag{6}$$

$$A_{31}\cdot\Delta S+A_{32}\cdot\Delta T_{b1}+A_{33}\cdot\Delta T_{f3}=0 \tag{7}$$

From the equations (6) and (7), $$\Delta T_{b1}=\frac{A_{23}\cdot A_{31}-A_{21}\cdot A_{33}}{A_{22}\cdot A_{33}-A_{23}\cdot A_{32}}\cdot\Delta S \tag{8}$$

Therefore, $$\alpha_1=\frac{A_{23}\cdot A_{31}-A_{21}\cdot A_{33}}{A_{22}\cdot A_{33}-A_{23}\cdot A_{32}} \tag{9}$$

Also from the equations (6), (7) and (9), $$T_{f3}=\frac{-1}{A_{23}}(A_{21}+A_{22}\cdot\alpha_1)\cdot\Delta S \tag{10}$$

Substituting the equation (9) for $\alpha_1$ in the equation (10), therefore, $$\beta_1=\frac{-1}{A_{23}}(A_{21}+A_{22}\cdot\alpha_1) \tag{11}$$

The value of $\alpha_1$ may be substituted for by the value determined by the equation (9). The coefficients $\alpha_1$ and $\beta_1$ may be determined in this way.

An example of calculation using measurement data obtained from an experimental rolling mill is given below. Assume that the roll-gap position reference value is to be increased by 0.01 mm, i.e., ΔS=0.01 mm. The following values have been obtained from the measurement data, as an example of the constants $A_{ij}$ in the equations (3), (4) and (5).

$$\left.\begin{aligned}A_{11}&=0.160\\A_{12}&=2.93\times10^{-5}\\A_{13}&=-5.25\times10^{-5}\\A_{21}&=0.256\\A_{22}&=2.93\times10^{-5}\\A_{23}&=1.90\times10^{-5}\\A_{31}&=0.392\\A_{32}&=-4.28\times10^{-5}\\A_{33}&=2.17\times10^{-5}\end{aligned}\right\} \tag{12}$$

These values are obtained by varying one of the corrections $\Delta S$, $\Delta T_{b1}$ and $\Delta T_{f3}$ in the right side of the equation (3), (4) or (5) and fixing other corrections and measuring the variation ($\Delta h_3$, $\Delta h_2$ or $\Delta h_1$) in the left side and determining the ratio between the measured variation ($\Delta h_3$, $\Delta h_2$ or $\Delta h_1$) and the "varied" correction ($\Delta S$, $\Delta T_{b1}$ or $\Delta T_{f3}$).

Substituting the above values in the equations (3), (4) and (5), $$\Delta h_3 = 0.160 \cdot \Delta S + 2.93 \times 10^{-5} \cdot \Delta T_{b1} - 5.25 \times 10^{-5} \cdot \Delta T_{f3} \quad (13)$$

$$\Delta h_2 = 0.256 \cdot \Delta S + 2.93 \times 10^{-5} \cdot \Delta T_{b1} + 1.90 \times 10^{-5} \cdot \Delta T_{f3} \quad (14)$$

$$\Delta h_1 = 0.392 \cdot \Delta S - 4.28 \times 10^{-5} \cdot \Delta T_{b1} + 2.17 \times 10^{-5} \cdot \Delta T_{f3} \quad (15)$$

Substituting $\Delta S = 0.01$ mm, $\Delta h_2 = \Delta h_1 = 0$ in the equations (13), (14) and (15), $$\Delta h_3 = +0.00316 (\text{mm}) \quad (16)$$

$$\Delta T_{b1} = +106.70 (\text{kgf}) \quad (17)$$

$$\Delta T_{f3} = +29.81 (\text{kgf}) \quad (18)$$

This means that when the roll-gap position reference value is increased by 0.01 mm in order to reduce the final thickness, the back tension reference value correction and the forward tension reference value correction should be increased by 106.70 kgf and 29.81 kgf, respectively, to restrain at substantially zero in the thickness deviation at the exit of the first and the second passes. The final thickness exceeds by 0.00316 mm.

In summary, the above-described embodiment varies the roll-gap position as the main parameter for giving an effect on the final thickness and varies the back tension and the forward tension as auxiliary parameters for cancelling the effect of variation of the main parameter on the intermediate thicknesses.

Figure 2:
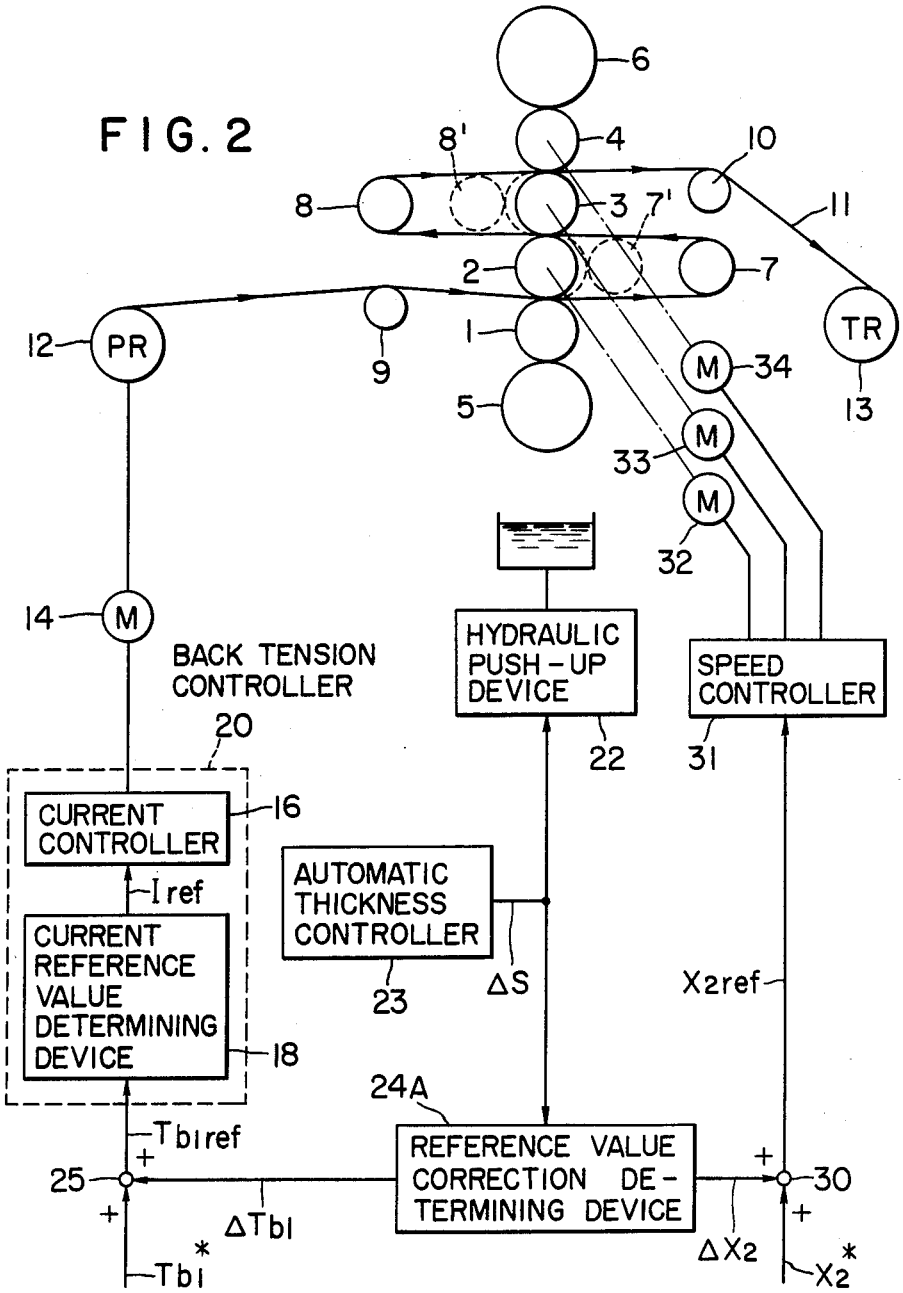

FIG. 2 shows another embodiment of the invention. The same reference numerals as in FIG. 1 denote the same or similar components. Although not illustrated, the tension reel 13 is driven by a motor under control of a forward tension controller. But this forward tension controller operates, unlike the controller 21 of FIG. 1, independently of a reference value correction determining device 24A, which is a counterpart of the determining device 24 of FIG. 1.

The reference value determining device 24A determines, in accordance with the correction $\Delta S$, the back tension reference value correction $\Delta T_{b1}$ and a second-pass speed difference ratio reference value correction $\Delta X_2$. The speed difference ratio reference value correction $\Delta X_2$ is added at an adder 30 to a speed difference ratio initial set value $X_2$* to result in a speed difference ratio reference value $X_{2ref}$, which is inputted to a speed controller 31. The speed controller 31 controls the speeds of motors 32, 33 and 34 respectively driving work rolls 2, 3 and 4.

The second-pass speed difference ratio $X_2$ is defined as:

$$X_2 = (V_3/V_2) - 1 \quad (19)$$

where $V_3$ represents the peripheral speed of the third work roll 4, and $V_2$ represents the peripheral speed of the second work roll 3.

A greater speed difference ratio gives a greater reduction (if other parameters are fixed). Accordingly, by varying the speed difference ratio, the effect of correction $\Delta S$ of the roll-gap position reference value on the thicknesses at the exit of the first and the second passes can be cancelled. The speed difference ratio reference value correction $\Delta X_2$ as well as the back tension reference value correction $\Delta T_{b1}$ is determined to cancel the effect of the correction $\Delta S$ on the intermediate thicknesses in accordance with the following equations:

$$\Delta T_{b1} = \alpha_2 \cdot \Delta S \quad (20)$$

$$\Delta X_2 = \beta_2 \cdot \Delta S \quad (21)$$

where $\alpha_2$ and $\beta_2$ represent reference value correction determining coefficients.

The coefficient $\alpha_2$ and $\beta_2$ can be determined in a manner similar to that in which the coefficients $\alpha_1$ and $\beta_1$ of the embodiment of FIG. 1 are determined.

Thus, it will be seen that the second embodiment adjusts the second pass speed difference ratio $X_2$ as one of the auxiliary parameters.

Figure 3:
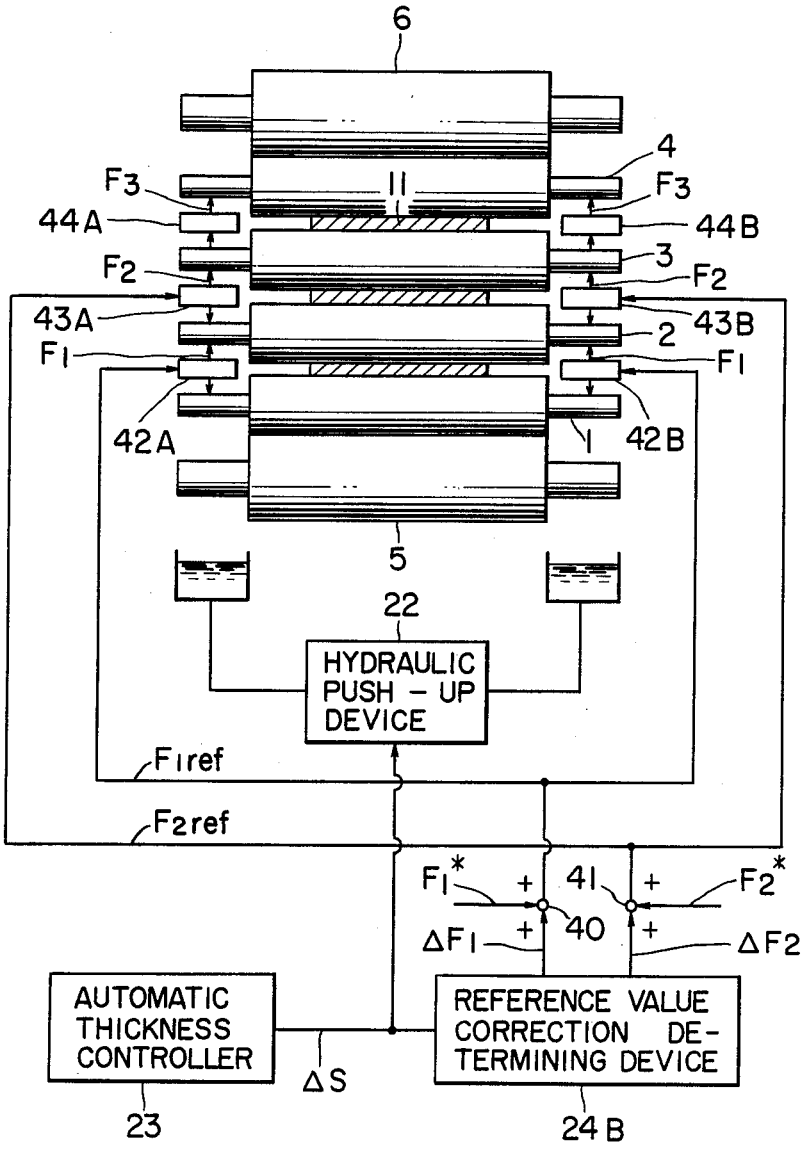

FIG. 3 shows a third embodiment of the invention. In this embodiment, a first-pass bender force $F_1$ and a second-pass bender force $F_2$ are adjusted as the auxiliary parameters.

A reference value correction determining device 24B determines, from the correction $\Delta S$, the corrections $\Delta F_1$ and $\Delta F_2$ in accordance with the following equations:

$$\Delta F_1 = \alpha_3 \cdot \Delta S \quad (22)$$

$$\Delta F_2 = \beta_3 \cdot \Delta S \quad (23)$$

The coefficients $\alpha_3$ and $\beta_3$ can be determined in a manner similar to that in which the coefficients $\alpha_1$ and $\beta_1$ of the embodiment of FIG. 1 are determined.

The corrections $\Delta F_1$ and $\Delta F_2$ are added at adders 40 and 41 to bender force initial set values $F_1$* and $F_2$*, respectively, to result in bender force reference values $F_{1ref}$ and $F_{2ref}$, which are applied to first-pass bender force controllers 42A, 42B and second-pass bender force controllers 43A, 43B, respectively. Bender force controllers function to adjust the force between adjacent rolls.

Figure 4:
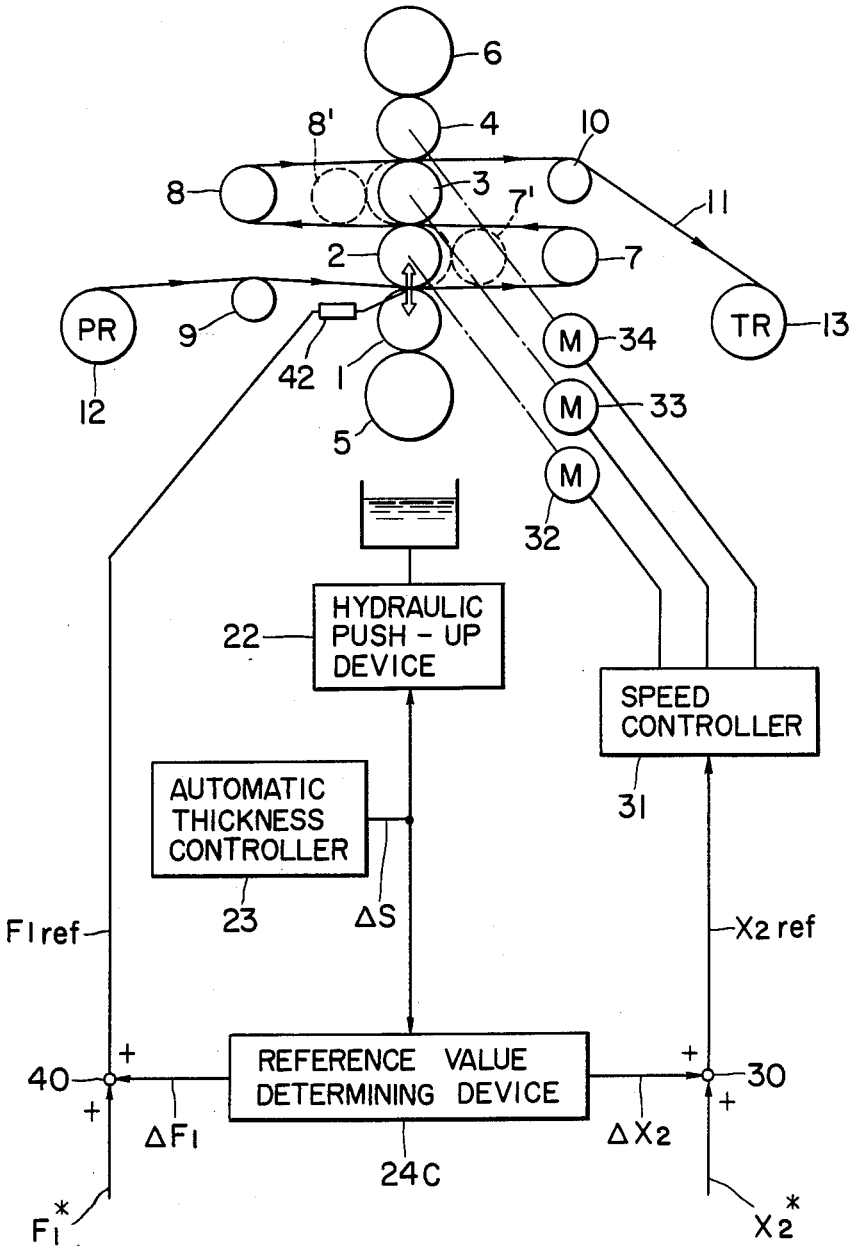

FIG. 4 shows a fourth embodiment of the invention, in which a first-pass bender force $F_1$ and a second-pass speed difference ratio $X_2$ are adjusted as the auxiliary parameters. A reference value correction determining device 24C determines, from the correction $\Delta S$, a first-pass bender force reference value correction $\Delta F_1$ and a second-pass speed difference ratio reference value correction $\Delta X_2$, in accordance with the following equations:

$$\Delta F_1 = \alpha_4 \cdot \Delta S \quad (24)$$

$$\Delta X_2 = \beta_4 \cdot \Delta S \quad (25)$$

where $\alpha_4$ and $\beta_4$ are coefficients and can be determined in a manner similar to that in which the coefficients $\alpha_1$ and $\beta_1$ of the embodiment of FIG. 1 are determined.

The corrections $\Delta F_1$ and $\Delta X_2$ are added at adders 40 and 30 to a first-pass bender force initial set value $F_1$* and a second-pass speed difference ratio initial set value $X_2$* to result in a first-pass bender force reference value $F_{1ref}$ and a second-pass speed difference ratio reference value $X_{2ref}$. A first-pass bender force controller 42 responds to the reference value $F_{1ref}$ and operates to maintain the first-pass bender force at the reference value $F_{1ref}$. A speed controller 31 responds to the reference value $X_{2ref}$ and operates to maintain the second-pass speed difference ratio at the reference value $X_{2ref}$.

Figure 5:
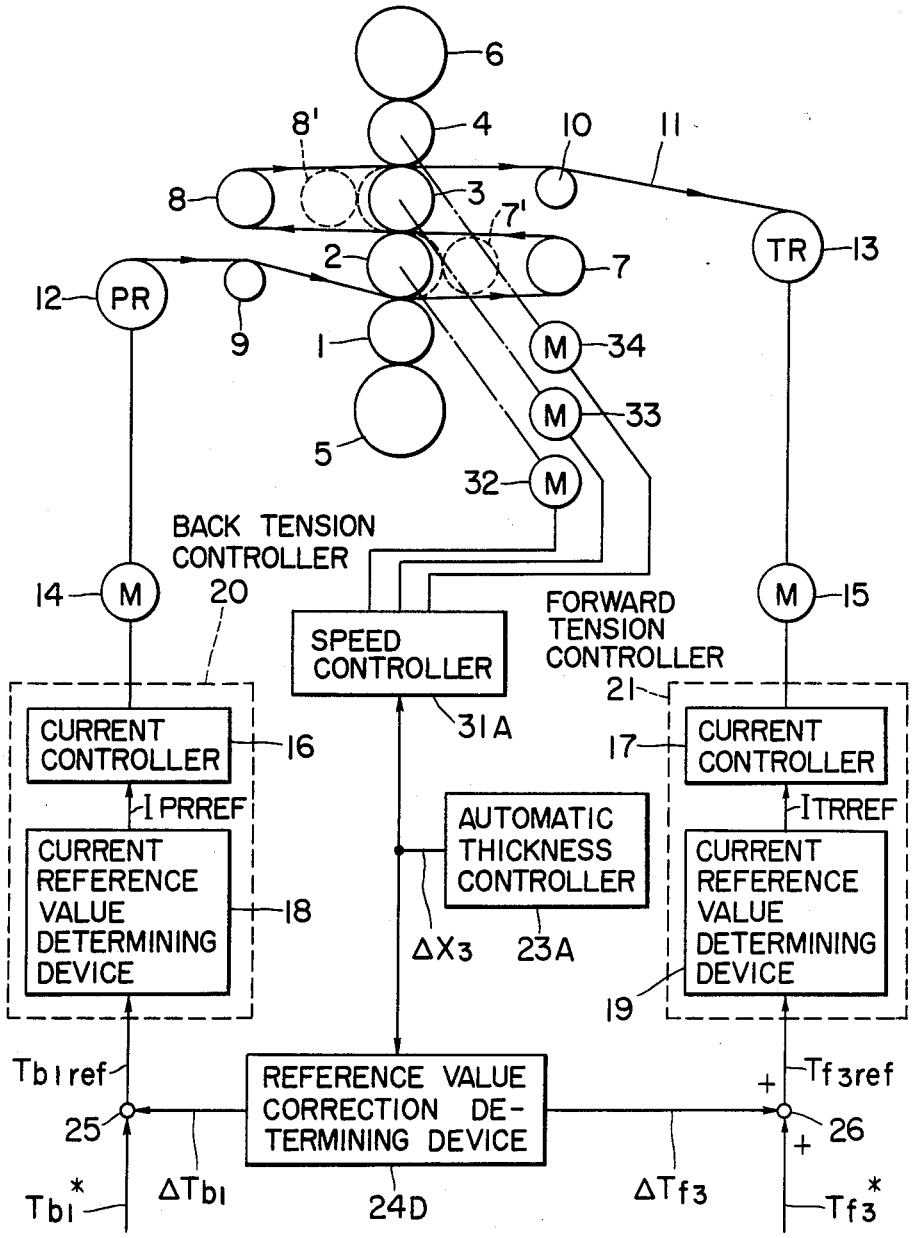

FIG. 5 shows a fifth embodiment of the invention, in which the third or final pass speed difference ratio $X_3$ is adjusted as the main parameter, and a back tension $T_{b1}$ and a forward tension $T_{f3}$ are adjusted as auxiliary parameters.

An automatic thickness control device 23A of this embodiment responds to the actual final thickness and produces, in accordance with a deviation of the final thickness from its reference value, a final-pass speed difference ratio reference value correction $\Delta X_3$. The correction $\Delta X_3$ is applied to a speed controller 31A which controls the speeds of motors 32, 33 and 34, and hence the speeds of the work rolls 2, 3 and 4 to maintain the actual speed difference ratio $X_3$ at its reference value as corrected by $\Delta X_3$.

The final speed difference ratio $X_3$ is defined as:

$$X_3=(V_4/V_3)-1 \tag{26}$$

where $V_4$ represents the peripheral speed of the fourth work roll 4, and $V_3$ represents the peripheral speed of the third work roll 3.

A reference value correction determining device 24D of this embodiment determines, from the correction $\Delta X_3$, a back tension reference value correction $\Delta T_{b1}$ and a forward tension reference value correction $\Delta T_{f3}$ in accordance with the following equations:

$$\Delta T_{b1}=\alpha_5\cdot\Delta X_3 \tag{27}$$

$$\Delta T_{f3}=\beta_5\cdot\Delta X_3 \tag{28}$$

where $\alpha_5$ and $\beta_5$ are coefficients and can be determined in a manner similar to that in which the coefficients $\alpha_1$ and $\beta_1$ of the embodiment of FIG. 1 are determined. It should however be noted that $\Delta X_3$ is used in place of $\Delta S$. More specifically, the following set of equations are formulated:

$$\Delta h_3=A_{11}'\cdot\Delta X_3+A_{12}'\cdot\Delta T_{b1}+A_{13}'\cdot\Delta T_{f3} \tag{29}$$

$$\Delta h_2=A_{21}'\cdot\Delta X_3+A_{22}'\cdot\Delta T_{b1}+A_{23}'\cdot\Delta T_{f3} \tag{30}$$

$$\Delta h_1=A_{31}'\cdot\Delta X_3+A_{32}'\cdot\Delta T_{b1}+A_{33}'\cdot\Delta T_{f3} \tag{31}$$

The following values have been obtained from measurement data as an example of the values of the constants $A_{ij}'$ (i,j=1 to 3).

$$\left.\begin{aligned} A_{11}' &= -0.500 \\ A_{12}' &= 2.93\times10^{-5} \\ A_{13}' &= -5.25\times10^{-5} \\ A_{21}' &= 0.129 \\ A_{22}' &= 2.93\times10^{-5} \\ A_{23}' &= 1.90\times10^{-5} \\ A_{31}' &= 0.229 \\ A_{32}' &= -4.28\times10^{-5} \\ A_{33}' &= 2.17\times10^{-5} \end{aligned}\right\} \tag{32}$$

Substituting the values of the equations (32) and substituting $\Delta X_3=0.01$ and $\Delta h_2=\Delta h_1=0$, $$\Delta h_3=-0.00595(\text{mm}) \tag{33}$$

$$\Delta T_{b1}=+87.474(\text{kgf}) \tag{34}$$

$$\Delta T_{f3}=+66.999(\text{kgf}) \tag{35}$$

This means that where the final-pass speed difference ratio is increased by 0.01 in order to reduce the final thickness, and if the back tension reference value and the forward tension reference value are increased by 87.474 kgf and 66.999 kgf, respectively, the variations in the intermediate thicknesses can be restrained to substantially zero and the final thickness becomes thinner by 0.00595 mm.

The time constant of the speed controller 31A is about 0.05 sec., while the time constants of the tension controllers 20 and 21 are about 0.01 sec. It is therefore necessary to employ some measure to attain matching in the response speed between the speed controller 31A and the tension controllers 20 and 21. For instance, a first order lag element may be inserted in each of the tension controllers 20 and 21 so that the response speeds as at the outputs of the tension controllers 20 and 21 match the response speed of the speed controller 22. Alternatively, the function of a first order lag element may be incorporated in the correction determining device 24D.

In the embodiments of FIG. 1, FIG. 2 and FIG. 5, the back tension is controlled by means of the torque of the drive motor of the pay-off reel. Where the strip material is fed from another roll stand, positioned upstream of the illustrated stand, the back tension may be controlled by means of the rolling speed ratio between the first pass of the illustrated stand and the above mentioned "another" roll stand positioned upstream.

Similarly, the forward tension may be controlled by means of the speed ratio between the final pass of the illustrated stand and another stand positioned downstream of the illustrated stand.

Variables other than those described above may be adjusted as the main parameter for controlling the final thickness and the auxiliary parameters for cancelling the effect of change of the main parameter on the intermediate thicknesses.

In the various embodiments described, three passes are formed in a single stand. But the number of passes can be other than three. In any case, the number of the auxiliary parameters whose reference value is corrected to cancel the effect of the correction of the main parameter on the intermediate thicknesses is preferably one less then the number of the passes. The correction determining coefficients for the respective auxiliary parameters can be determined by solving simultaneous equations formulated in a manner similar to that which was described. More particularly, a set of simultaneous equations are formulated, which can be expressed using matrix and vector equation as follows:

$$\begin{bmatrix} \Delta h_f \\ \Delta h_{f-1} \\ \cdot \\ \cdot \\ \cdot \\ \Delta h_2 \\ \Delta h_1 \end{bmatrix} = \begin{bmatrix} A_{11} & A_{12} & \cdots & A_{1f} \\ A_{21} & A_{22} & \cdots & A_{2f} \\ \cdot & \cdot & \cdot & \cdot \\ \cdot & \cdot & \cdot & \cdot \\ \cdot & \cdot & \cdot & \cdot \\ A_{f1} & A_{f2} & \cdots & A_{ff} \end{bmatrix} \begin{bmatrix} \Delta P_1 \\ \Delta P_2 \\ \cdot \\ \cdot \\ \cdot \\ \Delta P_f \end{bmatrix}$$

where $\Delta h_f$ represents a variation in the final thickness, $\Delta h_1$ through $\Delta h_{f-1}$ represent variations in the intermediate thicknesses, i.e., the thicknesses at the exit of the first, the second . . . the (f−1)th passes, $\Delta P_1$ represents a reference value correction of the main parameter, $\Delta P_2$ through $\Delta P_f$ represent reference value corrections of the auxiliary parameters whose reference value is corrected for cancelling the effect of the correction to the main parameter, and $A_{ij}$ (i,j=1 through f) are constants.

The constants $A_{ij}$ can be determined experimentally in a manner similar to that described in connection with the embodiment of FIG. 1. Each of the correction determining coefficients can be determined by substituting 0 for $\Delta h_1$ through $\Delta h_{f-1}$ and solving the simultaneous equations with respect to $\Delta P_1$ and the corresponding one of $\Delta P_2$ through $\Delta P_f$.

What is claimed is:

1. A thickness control method for controlling a final thickness of a strip material being rolled in a single-stand/multi-pass rolling mill, having adjustable main parameters affecting the final thickness and one or more auxiliary parameters affecting the intermediate thickness, said method comprising the steps of:

(a) determining a deviation of the final thickness from its reference value;

(b) correcting, in accordance with the deviation of the final thickness, a reference value of one of said main parameters to reduce the deviation of the final thickness; and (c) correcting, in accordance with the correction to the main parameter, a reference value of at least one of the auxiliary parameters to cancel the effect of the correction to the main parameter on the intermediate thickness.

2. A method of claim 1, wherein the correcting step c includes one less number of the auxiliary parameter than the number of the passes.

3. A method of claim 1, wherein the correcting step b utilizes a roll-gap position as the main parameter.

4. A method of claim 1, wherein the correcting step c utilizes a speed difference ratio between the work rolls of the final pass as the main parameter.

5. A method of claim 1, wherein the single-stand multi-pass rolling mill has three passes.

6. A method of claim 5, wherein the main parameter is a roll-gap position.

7. A method of claim 6, wherein the correcting step c utilizes a back tension and a forward tension as the auxiliary parameters.

8. A method of claim 6, wherein the correcting step c utilizes a back tension and the speed difference ratio between the work rolls of the second pass as the auxiliary parameters.

9. A method of claim 6, wherein the correcting step c utilizes bender forces at the first and the second passes as the auxiliary parameters.

10. A method of claim 6, wherein the correcting step c utilizes a bender force at the first pass and a speed difference ratio between the work rolls of the second pass as the auxiliary parameters.

11. A method of claim 5, wherein the main parameter is a speed difference ratio between the work rolls of the final pass.

12. A method of claim 11, wherein the correcting step c utilizes a back tension and a forward tension as the auxiliary parameters.

13. A thickness control system for controlling a final thickness of a strip material being rolled in a single-stand/multi-pass rolling mill, having main parameters which affect the final thickness and one or more auxiliary parameters which affect an intermediate thickness, said system comprising:

determining means for finding the deviation of the final thickness from its reference value;

first correcting means connected to said determining means for correcting a reference value of the main parameter to reduce the deviation of the final thickness, said first correcting means responsive to the deviation of said final thickness; and second correcting means connected to said first correcting means for correcting a reference value of at least one of the auxiliary parameters to cancel the effect of the correction to the main parameter on the intermediate thickness, said second correcting means responsive to the effect of said first correcting means on said intermediate thickness.

14. A system of claim 13, wherein the second correcting means requires one less number auxiliary parameter whose reference value need be corrected than the number of the passes, in order to fully cancel the effect of said first correction on said intermediate thickness.

15. A thickness control method for controlling a final thickness of a strip material being rolled in a single-stand/multi-pass rolling mill, having adjustable main parameters affecting the final thickness, said main parameters comprising a roll-gap position and a speed difference ratio between the work rolls of the final pass, and one or more auxiliary parameters affecting the intermediate thickness, said method comprising the steps of:

(a) determining a deviation of the final thickness from its reference value;

(b) correcting, in accordance with the deviation of the final thickness, a reference value of one of said main parameters to reduce the deviation of the final thickness; and (c) correcting, in accordance with the correction to the main parameter, a reference value of at least one of the auxiliary parameters to cancel the effect of the correction to the main parameter on the intermediate thickness.

16. A method as in claim 1, wherein the auxiliary parameters are selected from the group consisting of back tension, forward tension, speed difference ratio, and bender force.

* * * * *